US007774989B2

(12) United States Patent
Fisher

(10) Patent No.: US 7,774,989 B2
(45) Date of Patent: Aug. 17, 2010

(54) SNOW GUARD AND METHOD OF ATTACHING THE SAME

(75) Inventor: Levi S. Fisher, Bird-in-Hand, PA (US)

(73) Assignee: Levi's Nail and Screws, Leola, PA (US)

( * ) Notice: Subject to any disclaimer, the term of this patent is extended or adjusted under 35 U.S.C. 154(b) by 0 days.

(21) Appl. No.: 12/165,909

(22) Filed: Jul. 1, 2008

(65) Prior Publication Data

US 2010/0000161 A1 Jan. 7, 2010

(51) Int. Cl.
*E04D 13/10* (2006.01)

(52) U.S. Cl. ..... 52/26; 52/24

(58) Field of Classification Search ..... 52/24, 52/25, 26; D8/499
See application file for complete search history.

(56) References Cited

U.S. PATENT DOCUMENTS

| | | | | | |
|---|---|---|---|---|---|
| 507,776 | A | | 10/1893 | Berger et al. | |
| 595,295 | A | | 12/1897 | Fox et al. | |
| D30,788 | S | | 5/1899 | Clark | |
| 884,850 | A | | 4/1908 | Peter | |
| 1,095,822 | A | | 5/1914 | Danzer | |
| 1,330,309 | A | | 2/1920 | Dixon | |
| 1,463,065 | A | | 7/1923 | Sieger | |
| 1,863,561 | A | * | 6/1932 | Brinker et al. | 52/24 |
| 4,141,182 | A | | 2/1979 | McMullen | |
| D254,051 | S | | 1/1980 | Zaleski | |
| 5,044,130 | A | | 9/1991 | Chiddister | |
| 5,271,194 | A | | 12/1993 | Drew | |
| 5,282,340 | A | * | 2/1994 | Cline et al. | 52/24 |
| 5,483,772 | A | | 1/1996 | Haddock | |
| 5,491,931 | A | | 2/1996 | Haddock | |
| 5,522,185 | A | | 6/1996 | Cline | |
| 5,694,721 | A | | 12/1997 | Haddock | |
| 5,983,588 | A | | 11/1999 | Haddock | |
| D418,403 | S | | 1/2000 | Cline | |
| 6,164,033 | A | | 12/2000 | Haddock | |
| D453,678 | S | | 2/2002 | McMullen | |
| 6,499,259 | B1 | * | 12/2002 | Hockman | 52/26 |
| 6,536,166 | B1 | * | 3/2003 | Alley | 52/25 |
| 6,647,671 | B1 | | 11/2003 | Alley | |
| 6,688,047 | B1 | | 2/2004 | McNichol | |
| 6,718,718 | B2 | | 4/2004 | Haddock | |
| 6,834,466 | B2 | * | 12/2004 | Trevorrow et al. | 52/24 |

(Continued)

FOREIGN PATENT DOCUMENTS

| | | |
|---|---|---|
| AT | 223795 | 10/1962 |

(Continued)

*Primary Examiner*—D. Dunn
*Assistant Examiner*—Christine T Cajilig
(74) *Attorney, Agent, or Firm*—Barley Snyder LLC

(57) ABSTRACT

A snow guard and a method of attaching a snow guard to a seam of a metal roof wherein the snow guard includes a base having a first side wall, a second side wall, and a top wall that define a seam receiving channel. The first side wall is provided with at least one opening. The second side wall has at least one fixed projection extending from the second side wall into the seam receiving channel and toward the opening. At least one moveable fastener extends through the opening into the seam receiving channel and toward the projection, and a blade is attached to a base receiving end of the base.

19 Claims, 3 Drawing Sheets

U.S. PATENT DOCUMENTS

| | | | | |
|---|---|---|---|---|
| 7,127,852 | B1 * | 10/2006 | Dressler | 52/24 |
| 7,213,373 | B2 | 5/2007 | Hockman | |
| 7,513,080 | B1 * | 4/2009 | Showalter | 52/24 |
| 2001/0045064 | A1 * | 11/2001 | Alley | 52/25 |
| 2005/0102958 | A1 * | 5/2005 | Anderson | 52/698 |

FOREIGN PATENT DOCUMENTS

| | | | |
|---|---|---|---|
| DE | 3716491 | A1 | 12/1988 |
| DE | 3723020 | A1 | 1/1989 |

* cited by examiner

SNOW GUARD AND METHOD OF ATTACHING THE SAME

FIELD OF THE INVENTION

The invention relates to a snow guard and a method of attaching a snow guard to a seam of a metal roof wherein the snow guard includes a base provided with a seam receiving channel and at least one fastener that extends into the seam receiving channel to attach the snow guard to the seam of the roof.

BACKGROUND

When snow or ice that has accumulated on a roof begins to melt, the water generated from the melted snow or ice is guided by the surface of the roof toward edges of the roof so that the water runs off the edges thereof. On standing seam metal roofs, the water on the surface of the roof tends to make the surface of the roof slick, which can cause large sheets of snow or ice to slide along the surface of the roof toward the edges. In order to prevent the sheets of snow and ice from falling off the edges of the roof, it is know to attach snow guards to the roof so that the sheets of snow and ice are held on the roof until the sheets of snow and ice either completely melt or are reduced in size.

There are several known ways to attach the snow guards to the roof. For example, the snow guards may be attached to the surface of the roof by screws, nails, or other fasteners that pierce the surface of the roof. Because the attachment of these snow guards require piercing the surface of the roof, the melted snow and ice can easily leak into the openings created by the fasteners. Alternatively, the snow guards may be clamped to the seams of the roof. However, the known clamping operations are complex, require multiple moving components, and often significantly bend or deform the seam of the roof. As a result, it is not only difficult to attach and remove these snow guards from the roof, but also the snow guards damage the seam of the roof. A need therefore exists to provide a snow guard that can easily be secured to and removed from the roof without negatively impacting the integrity of the roof.

SUMMARY

The invention relates to a snow guard comprising a base having a first side wall, a second side wall, and a top wall that define a seam receiving channel. The first side wall is provided with at least one opening. The second side wall has at least one fixed projection extending from the second side wall into the seam receiving channel and toward the opening. At least one moveable fastener extends through the opening into the seam receiving channel and toward the projection, and a blade is attached to a base receiving end of the base.

The invention further relates to a method for attaching a snow guard to a seam of a metal roof, comprising: inserting the seam of the metal roof into a seam receiving channel defined by a first side wall, a second side wall, and a top wall of a base; engaging a first side of the seam with at least one fixed projection extending from the second side wall into the seam receiving channel; advancing a moveable fastener through an opening in the first side wall toward a second side of the seam; and clamping the seam between the fastener and the projection.

DETAILED DESCRIPTION OF THE EMBODIMENT(S)

Figure 1:
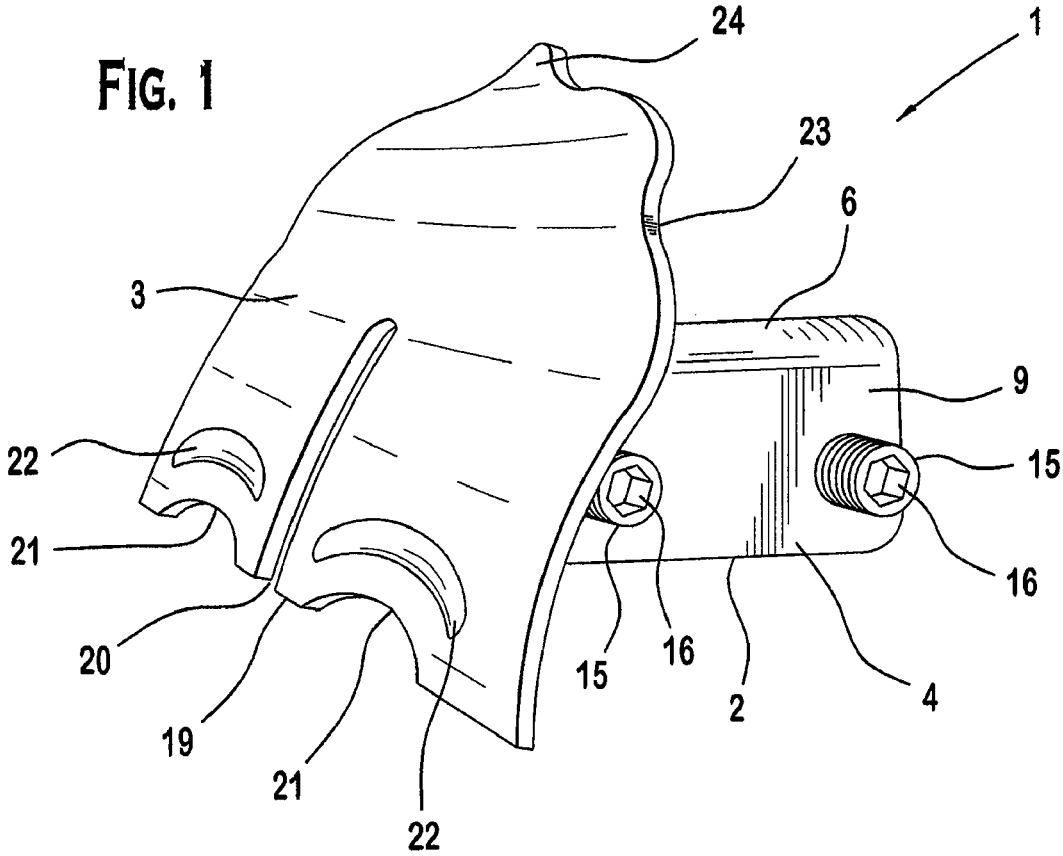
FIG. 1 is a front perspective view of a snow guard according to an embodiment of the invention.
Figure 2:
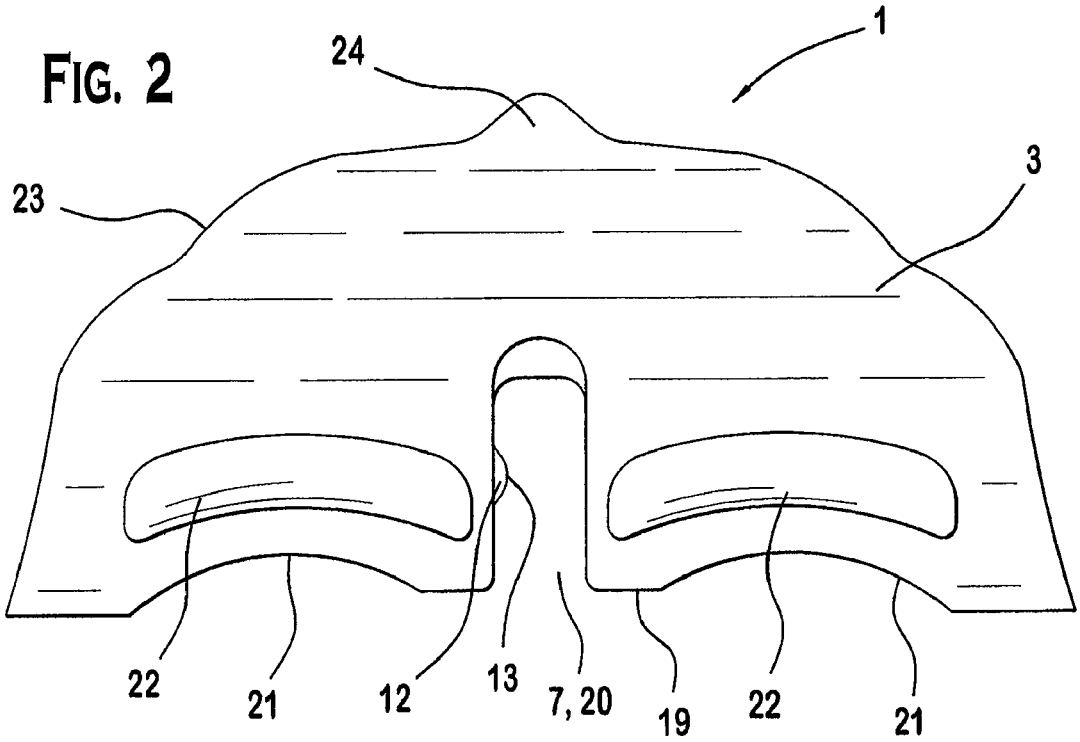
FIG. 2 is a front view of the snow guard shown in FIG. 1.
Figure 3:
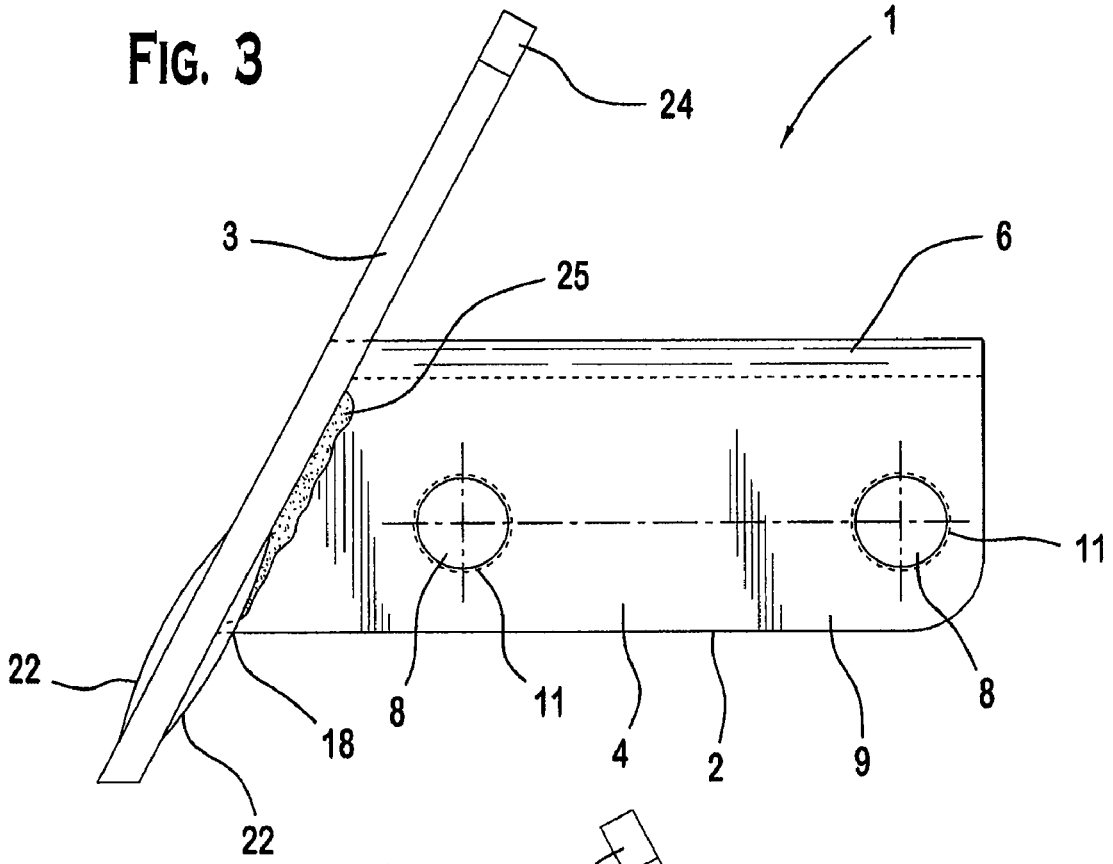
FIG. 3 is a first side view of the snow guard shown in FIG. 1 showing the snow guard without fasteners provided in openings therein.
Figure 4:
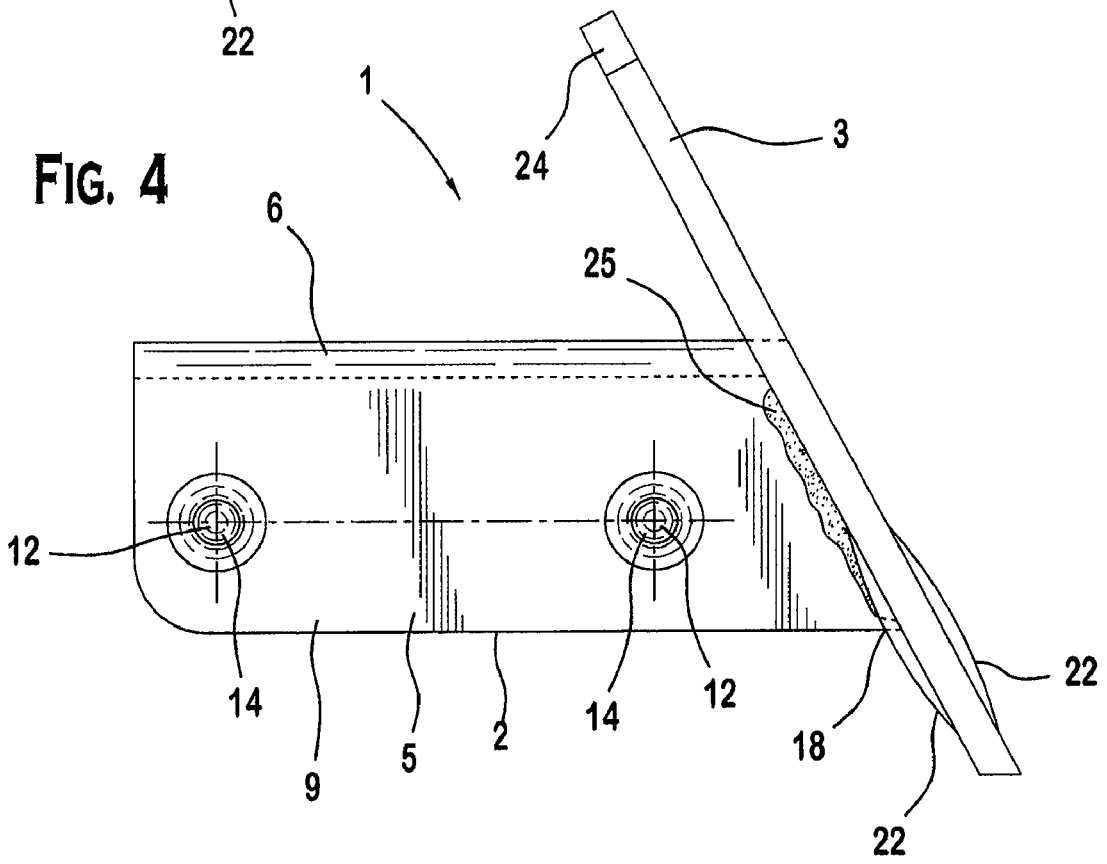
FIG. 4 is a second side view of the snow guard shown in FIG. 1.
Figure 5:
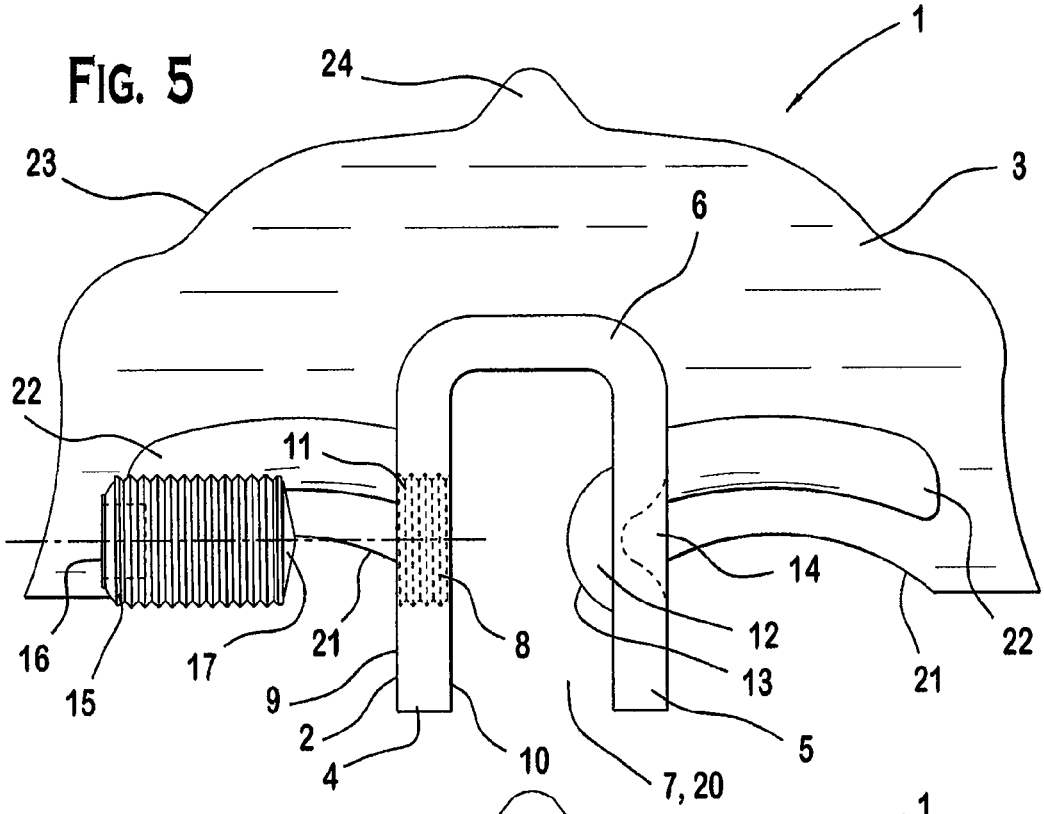
FIG. 5 is an exploded rear view of the snow guard shown in FIG. 1.

FIGS. 1-6 shows a snow guard 1 according to an embodiment of the invention. As shown in FIG. 1, the snow guard 1 comprises a base 2 and a blade 3. The base 2 may be formed, for example, from a metal plate. As shown in FIGS. 3-5, the base 2 is substantially U-shaped and has a substantially inclined blade receiving end 18. The base 2 includes a first side wall 4, a second side wall 5, and a top wall 6. The first side wall 4 extends substantially parallel to the second side wall 5 and is spaced there from. The top wall 6 extends between a top surface of the first side wall 4 and the second side wall 5. The top wall 6 extends substantially perpendicular to the first side wall 4 and the second side wall 5. The first side wall 4, the second side wall 5, and the top wall 6 have a substantially uniform thickness. The first side wall 4, the second side wall 5, and the top wall 6 define a substantially U-shaped seam receiving channel 7.

As shown in FIGS. 3 and 5, the first side wall 4 is provided with openings 8. The openings 8 extend from an outside surface 9 to an inside surface 10 of the base 2. The openings 8 may be provided with a plurality of threads 11. As shown in FIGS. 4-5, the second side wall 5 is provided with fixed projections 12. The projections 12 are arranged opposite the openings 8 and correspond thereto. The projections 12 extend from the second side wall 5 toward the openings 8 into the seam receiving channel 7. The projections 12 have substantially convex end portions 13. The projections 12 may be, for example, materially formed in one piece with the second side wall 5 by a forming process wherein the projections 12 are formed by pressing the outside surface 9 of the base 2 inward toward the inside surface 10 of the base 2. When the projections 12 are formed by the aforementioned forming process, a depression 14 is formed on the outside surface 9 of the base 2 opposite each of the projections 12.

As shown in FIGS. 1 and 5, moveable fasteners 15 are received in each of the openings 8. Although the fasteners 15 shown and described herein are set screws, it will be appreciated by those skilled in the art that other types of fasteners may be used. The fasteners 15 may have, for example, thread on an outer surface thereof corresponding to the threads 11 of the openings 8. Each of the fasteners 15 has a first end formed with a cavity 16 configured, for example, to receive a tool, such as a hex key or screw driver, and a second end provided with a substantially convex end portion 17.

As shown in FIGS. 1-2, the blade 3 is a substantially rigid plate. The blade 3 may be formed, for example, from a metal plate. The blade 3 is provided with a substantially U-shaped seam receiving channel 20. The seam receiving channel 20 is arranged in a substantial center of the blade 3 and extends upward from a lower surface 19 thereof. The seam receiving channel 20 has substantially the same height and width dimensions as the seam receiving channel 7 of the base 2. On opposite sides of the seam receiving channel 20, the lower surface 19 of the blade 3 is provided with substantially arcuate cut-outs 21 that extend upward from the lower surface 19. Substantially arcuate protrusions 22 are formed on both sides of the blade 3 on opposite sides of the seam receiving channel 20 substantially above the cut-outs 21. An upper surface 23 of the blade 3 is substantially arcuate and is provided with a plurality of curves. The upper surface 23 has a point 24 provided at a substantial center of a top thereof.

As shown in FIGS. 4-5, the blade 3 is attached to the blade receiving end 18 of the base 2, for example, by welding 25, such that the blade 3 extends upward and outward at an angle with respect to the base 2. The blade 3 is attached to the blade receiving end 18 such that the lower surface 19 is substantially aligned with a bottom of the base 2, and the blade 3 extends substantially perpendicular to a longitudinal axis of the base 2. When the blade 3 is attached to the base 2, the seam receiving channel 20 of the blade 3 communicates with the seam receiving channel 7 of the base 2.

Figure 6:
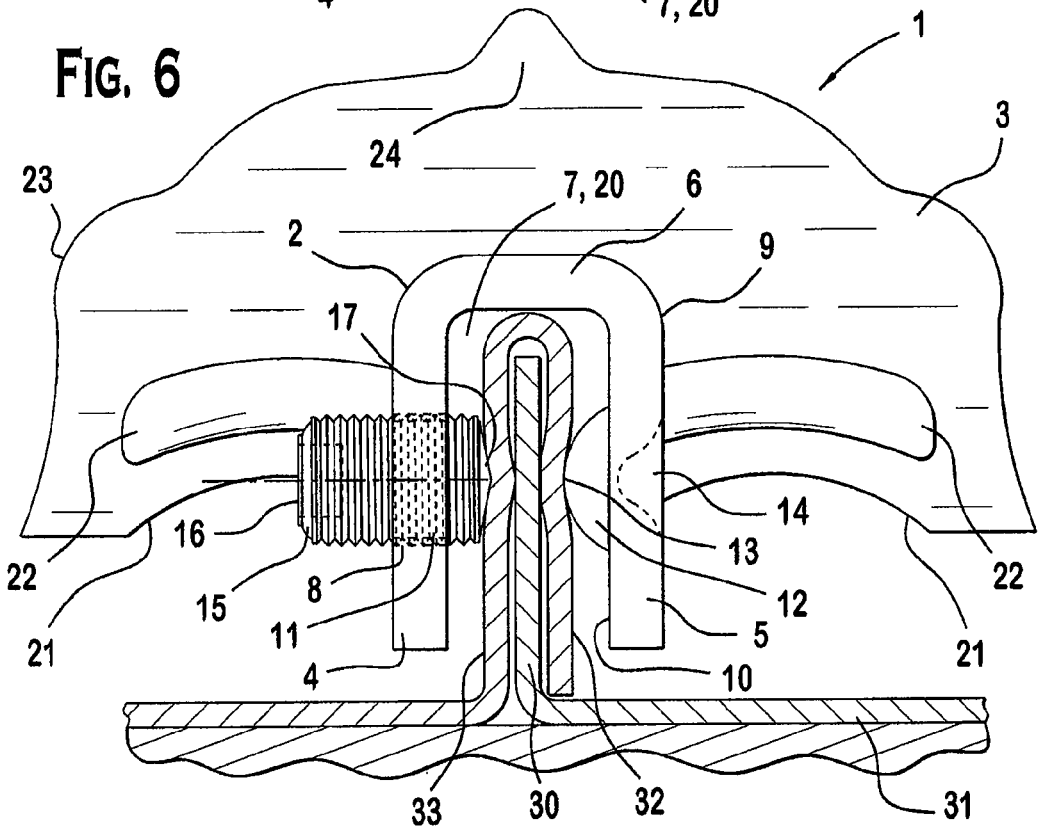
FIG. 6 is a rear view of the snow guard shown in FIG. 1 showing the snow guard assembled to a seam of a metal roof.

A method for attaching the snow guard 1 to a seam 30 of a metal roof 31 will now be described with reference to FIG. 6. As shown in FIG. 6, to assemble the snow guard 1 to the metal roof 31, the seam 30 of the metal roof 31 is inserted into the seam receiving channel 7 of the base 2 and the seam receiving channel 20 of the blade 3 such that the seam 30 is positioned between the first side wall 4 and the second side wall 5. A first side 32 of the seam 30 is positioned adjacent to the projections 12, and a second side 33 of the seam 30 is positioned adjacent to the openings 8. The fasteners 15 are inserted into the openings 8 in the first side wall 4 and are advanced into the openings 8, for example, with the tool, until the fasteners 15 engage the seam 30 of the metal roof 31 thereby clamping the seam 30 between the substantially convex end portions 13 of the projections 12 and the substantially convex end portions 17 of the fasteners 15. The snow guard 1 is thereby securely fixed to the seam 30 of the metal roof 31.

In order to remove the snow guard 1 from the metal roof 31, the fasteners 15 are retracted from the openings 8, for example, with the tool, until the fasteners 15 are removed from engagement with the seam 30 of the metal roof 31. The snow guard 1 can then be easily removed from the seam 30. The snow guard 1 according to the embodiment of the invention therefore can easily be secured to and removed from the seam 30 of the metal roof 31 without negatively impacting the integrity of the metal roof 31.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A snow guard, comprising:

a base having a first side wall, a second side wall, and a top wall that define a seam receiving channel, the first side wall being provided with at least one opening, the second side wall having a plurality of discrete projections adapted to deform the seam, each discrete projection arranged opposite to and corresponding with at least one opening and extending from the second side wall into the seam receiving channel and toward the opening;

at least one moveable fastener adapted to engage the seam, and extending through the opening into the seam receiving channel and toward the projection; and a blade attached to a base receiving end of the base.

2. The snow guard of claim 1, wherein the projection has a substantially convex end portion that opposes a substantially convex end portion of the fastener.

3. The snow guard of claim 1, wherein the projection is materially formed in one piece with the second side wall.

4. The snow guard of claim 1, wherein the blade receiving end is inclined.

5. The snow guard of claim 1, wherein the blade extends upward and outward with respect to the base.

6. The snow guard of claim 1, wherein the blade includes a seam receiving channel that communicates with the seam receiving channel of the base.

7. The snow guard of claim 1, wherein the blade has a lower surface substantially aligned with a bottom of the base that is provided with cut-outs extending upward from the lower surface.

8. The snow guard of claim 1, wherein the fastener is a set screw.

9. The snow guard of claim 1, wherein the first side wall, the second side wall, and the top wall have a uniform thickness.

10. The snow guard of claim 1, wherein the opening and the fastener are provided with corresponding threads.

11. A method for attaching a snow guard to a seam of a metal roof, comprising:

inserting the seam of the metal roof into a seam receiving channel defined by a first side wall, a second side wall, and a top wall of a base;

engaging a first side of the seam with at least two discrete projections each arranged opposite to and corresponding with at least one opening, each discrete projection extending from the second side wall into the seam receiving channel and adapted to deform the seam;

advancing a moveable fastener through an opening in the first side wall toward and engaging a second side of the seam; and clamping the seam between the fastener and the projection, wherein a convex end of the fastener and a convex end of the corresponding projection engages and deforms the seam to securely fix the snow guard to the seam of the metal roof.

12. The method of claim 11, wherein the projection is materially formed in one piece with the second side wall.

13. The method of claim 11, wherein the fastener is a set screw.

14. The method of claim 11, wherein the first side wall, the second side wall, and the top wall have a uniform thickness.

15. The method of claim 11, wherein the opening and the fastener are provided with corresponding threads.

16. The method of claim 11, further comprising inserting the seam into a seam receiving channel in a blade attached to a blade receiving end of the base wherein the seam receiving channel of the blade communicates with the seam receiving channel of the base.

17. The method of claim 16, wherein the blade receiving end is inclined.

18. The method of claim 16, wherein the blade extends upward and outward with respect to the base.

19. The method of claim 16, wherein the blade has a lower surface substantially aligned with a bottom of the base that is provided with cut-outs extending upward from the lower surface.

* * * * *